United States Patent [19]

Grantz et al.

[11] 4,121,381

[45] Oct. 24, 1978

[54] JOINTED WINDOW LIFTER, ESPECIALLY FOR MOTOR VEHICLES

[75] Inventors: Helmut Grantz, Sindelfingen; Heinz Faix, Gechingen, both of Fed. Rep. of Germany

[73] Assignee: Daimler-Benz Aktiengesellschaft, Fed Rep. of Germany

[21] Appl. No.: 786,451

[22] Filed: Apr. 11, 1977

[30] Foreign Application Priority Data

Apr. 13, 1976 [DE] Fed. Rep. of Germany ..... 2616239

[51] Int. Cl.[2] ..... E05F 11/52; E05F 11/44

[52] U.S. Cl. ..... 49/227; 49/249; 49/250; 49/351

[58] Field of Search ..... 49/227, 230, 232, 233, 49/248, 249, 250, 348–351

[56] References Cited

U.S. PATENT DOCUMENTS

| | | | |
|---|---|---|---|
| 2,819,066 | 1/1958 | Hadwin, Jr. | 49/227 |
| 3,400,489 | 9/1968 | Stenger et al. | 49/348 |
| 3,604,151 | 9/1971 | Ventre et al. | 49/227 |

FOREIGN PATENT DOCUMENTS

| | | | |
|---|---|---|---|
| 1,555,172 | 8/1970 | Fed. Rep. of Germany | 49/351 |

*Primary Examiner*—Philip C. Kannan
*Attorney, Agent, or Firm*—Craig & Antonelli

[57] ABSTRACT

An articulated window lifter, especially for motor vehicles, whose windowpane is to be not only lowered within predetermined boundaries but also has to be laterally displaced and pivoted for purposes of avoiding door frame parts and the like which lie in its way; a pinion supported on a base plate engages with a toothed sector which is pivotally supported on the base plate while linkage parts are pivotally connected with the toothed sector; two four-jointed transmissions with a common fixed pivot point on a base plate are thereby used in superposed relationship, whereby one of the four-jointed transmissions has a further pivot point on the base plate and includes two pivot arms pivotally supported in the two pivot points on the base plate and a rod connecting the two pivot arms with each other; the other four-jointed transmission includes a first pivot arm connected at a fixed angle, with a first one of the two pivot arms of the one four-jointed transmission; the first pivot arm of the other four-jointed transmission is thereby connected with a second pivot arm of the other four-jointed transmission by way of a connecting rod; the second pivot arm of the other four-jointed transmission is pivotally connected by way of a couple with the one pivot arm of the one four-jointed transmission; and the couple is also connected with the connecting rod of the one four-jointed transmission at a fixed angle whose apex lies along a toothed sector.

25 Claims, 4 Drawing Figures

FIG 1
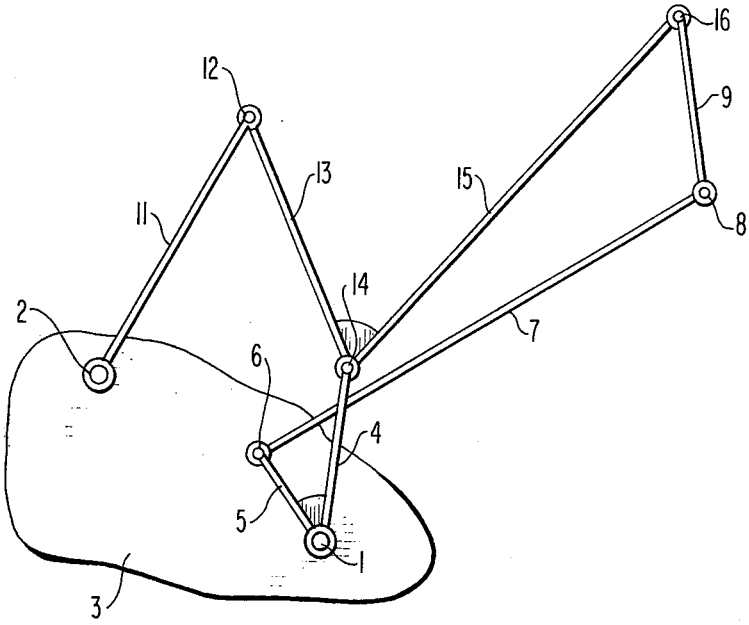
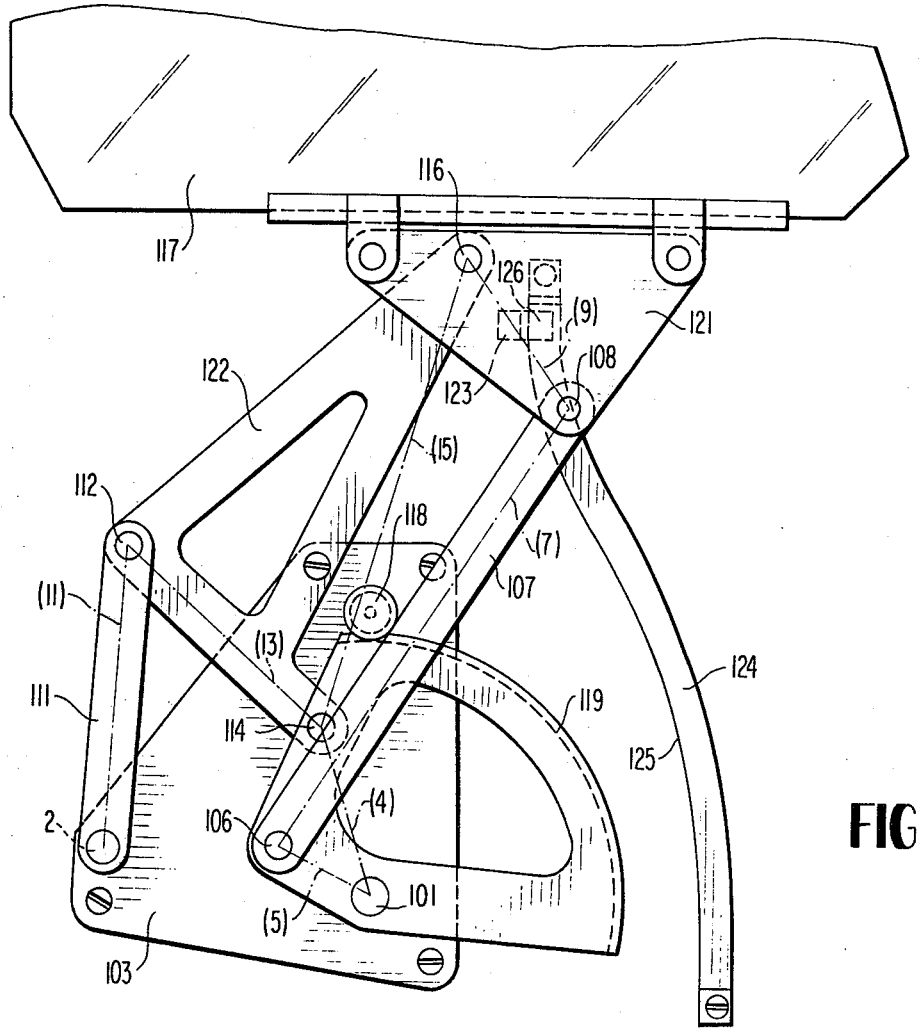
FIG 2

JOINTED WINDOW LIFTER, ESPECIALLY FOR MOTOR VEHICLES

The present invention relates to a jointed or articulated window lifter, especially for motor vehicles, whose windowpane not only has to be lowered within predetermined boundaries but also has to be laterally displaced and pivoted by reason of door frame parts and the like which lie in the way and are to be by-passed, including a pinion supported on a base plate, which engages with a toothed sector that is pivotally supported on the base plate and to which linkage parts are pivotally connected.

Heretofore known window lifters require one or several curve-shaped C-profile rails for the lowering operation in which slides a springy cheek. Also the use of further pivotal guide rails, over which slide two cheeks in order to pivot the windowpane, are known in the prior art. Additionally, it was necessary to utilize a pivot lever with a length-equalizing arm in order to lift the windowpane. The prior art window lifters were disadvantageous because they exhibited a high cost owing to the guide elements used with the same. These guide elements also entailed a high friction which could be further enhanced by moisture, dirt and inadequate lubrication. It even came readily to a wedging or jamming of the guide elements in these prior art constructions which in turn again required a large amount of installation and adjustment work so that in many cases large costs had to be expended. Additionally, by reason of the play required between the guide elements, an excessive yieldingness resulted in the driving direction, which did not permit the lowering of the pane along a predetermined path without unsteadiness or wobbling. Furthermore, the necessary clearance also led readily to a wedging or jamming. Moreover, a jamming also occurred frequently as cause of a kinematically conditioned near dead-center position in the prior art window lifters.

It is the aim of the present invention to avoid the described disadvantage and to lower the windowpane essentially without slide guidances, whereby exclusively in the vehicle transverse direction a simple support of the windowpane is to be permitted. As to the rest, the side windows of the vehicle are to be lowered along predetermined paths with the existing, spatial dimensions conditioned by the outer configuration, whereby the required stroke and pivot movement is to be enabled, to the greatest extent possible, under avoidance of friction and only by the use of levers and joints. A path-forming rail is thus to be obviated by the present invention.

The window guidance of frameless rear side windows of coupe vehicles represents a particular problem because in such a case, the windowpane cannot be lowered downwardly in a simple, rectilinear manner. On the one hand, it has to be guided in front past the lock and, on the other, it cannot contact the vehicle body inner shell. Therebeyond, the space available for the windowpane in its lowermost position is limited by the inner parts of the wheel casing so that a pivoting of the windowpane is necessary in order to accommodate the same completely. Also, this problem is to be solved by the present invention.

As a solution to the underlying problem, the present invention proposes a superposition of two four-jointed transmissions or linkage systems with a common fixed joint or pivot point on a base plate and with a further fixed joint or pivot point of the one four-jointed transmission on the same base plate, which includes two cranks or pivot arms supported in the mentioned joints or pivot points and a rod connecting the same with each other, whereas the other four-jointed transmission includes a pivot arm or crank connected at a fixed angle with one pivot arm or crank of the one four-jointed transmission, which is connected with a further pivot arm or crank by a rod, which further pivot arm or crank is pivotally connected by way of a couple with the one pivot arm or crank and with the rod, whereby the couple is again connected with the rod at a fixed angle whose apex joint point is arranged on a toothed sector.

According to a further feature of the present invention, the toothed sector may represent at the same time two pivot arms or cranks fixedly connected with each other of the two four-jointed transmissions and the one joint or pivot point formed by the toothed sector may be connected by a connecting rod with a fastening plate retaining the windowpane, which thus includes thereat one joint or pivot point as well as a further joint or pivot point of a four-jointed transmission, which is connected by a couple with a joint or pivot point disposed at the toothed sector of the other four-jointed transmission, at which joint or pivot point is pivotally connected a rod connected at a fixed angle with the couple and a crank or pivot arm is pivotally connected at the rod by way of a third joint or pivot point which last-mentioned pivot arm or crank is pivotally connected in the fixed joint or pivot point at the base plate. In order that the fastening plate carrying the windowpane cannot deflect laterally in the transverse direction of the vehicle, provision is made additionally according to the present invention that a preferably U-shaped slide shoe is secured at the fastening plate, which effects a lateral guidance of the fastening plate with respect to a slide rail whereby the legs of the slide rail extend over the edge of the slide rail.

Finally, it is possible within the scope of the present invention by a change of the arrangement and of the length of the articulated linkage parts of the four-jointed transmission to change the movement path of the windowpane and to adapt the same to other conditions, whereby it is made possible to lower frameless windows or windows with non-parallel edges without expensive guide elements or to lower windowpanes even nearly rectilinearly and nearly without any pivoting thereof. It is possible thereby to determine freely the lowering direction. The absence of slot guidances or guide elements, except for the cross support, reduces the friction and a jamming is precluded.

For simplifying the construction, it is also possible within the frame of the present invention to replace at least one lever which carries out only small movements by a slot guidance.

Accordingly, it is an object of the present invention to provide an articulated window lifter, especially for motor vehicles, which avoids by simple means the aforementioned shortcomings and drawbacks encountered in the prior art.

Another object of the present invention resides in an articulated window lifter for motor vehicles which eliminates the need for costly guide elements.

A further object of the present invention resides in an articulated window lifter of the type described above which far-reachingly precludes a wedging and jamming of the window, yet eliminates excessive clearances to avoid unsteadiness of the window during its lowering.

Still another object of the present invention resides in a jointed window lifter which obviates the need for slide guidances except for a simple support in the vehicle transverse direction.

A further object of the present invention resides in an articulated window lifter which is simple in construction, requires little space and permits a ready adaptation of the lowering movement to the existing and prevailing conditions in the vehicle.

These and other objects, features and advantages of the present invention will become more apparent from the following description when taken in connection with the accompanying drawing which shows, for purposes of illustration only, two embodiments in accordance with the present invention and wherein:

FIG. 1 is a schematic view illustrating the superposition of two four-jointed transmissions of a window lifter in accordance with the present invention for purposes of explanation thereof;

FIG. 2 is an elevational view of one embodiment of an articulated window lifter according to the present invention;

Figure 3:
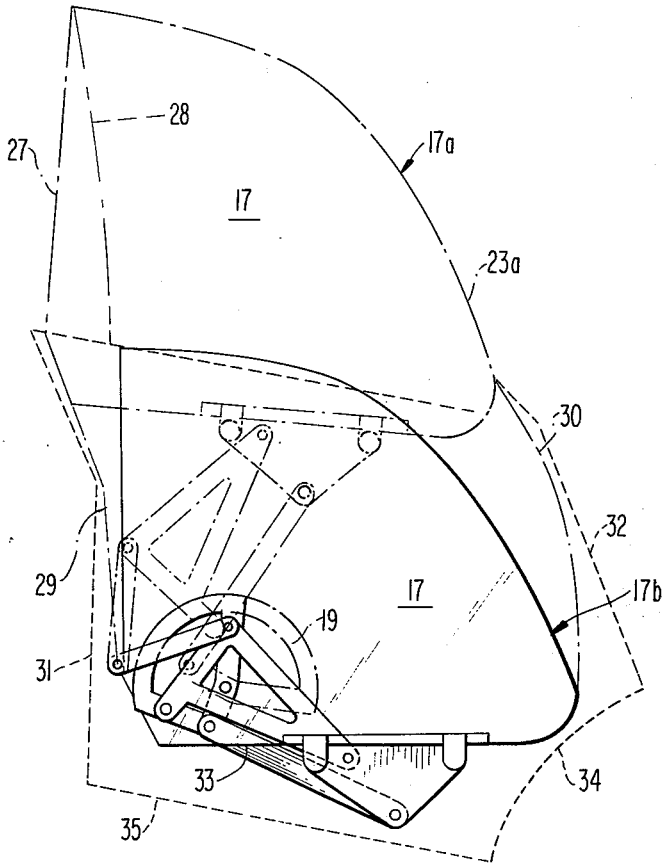
Figure 4:
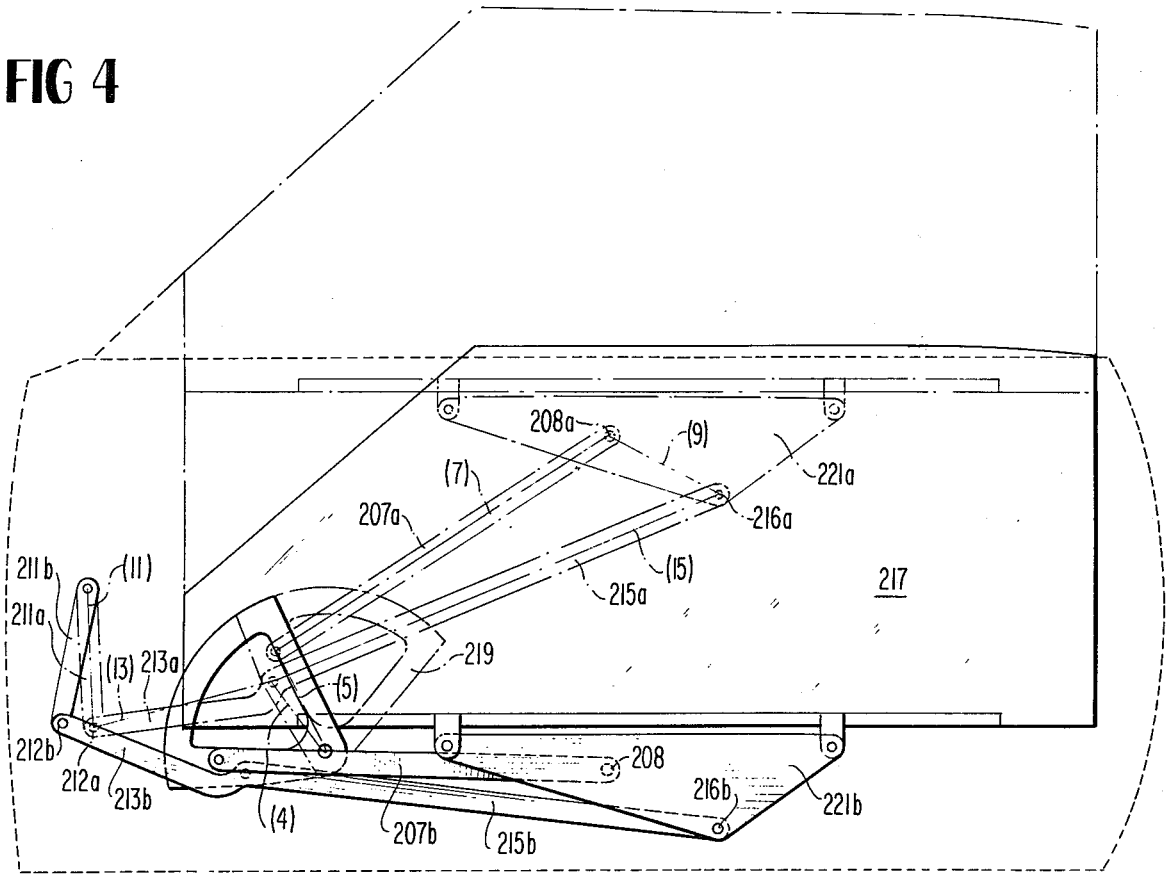

FIG. 3 is an elevational view of a window lifter in accordance with the present invention, illustrating the window to be lowered in its uppermost and lowermost position with indicated paths which pass through marked points of the pane during the movement from the upper position into the lower position; and FIG. 4 is an elevational view of a modified embodiment of an articulated window lifter according to the present invention with different dimensions of the linkage parts which enable a verticle lowering of the windowpane.

Referring now to the drawing wherein like reference numerals are used throughout the various views to designate like parts, and more particularly to FIG. 1, in this figure two superposed four-jointed transmissions are illustrated, i.e., the two four-jointed transmissions have a common joint or pivot point. The two four-jointed transmissions are pivotally connected on a base plate 3 by means of two joint or pivot points 1 and 2 of which the pivot point 1 is common to the two four-jointed transmissions. The one four-jointed transmission includes a crank or pivot arm 5 which, on the one hand, can be pivoted about the common joint or pivot point 1 fixedly arranged on the base plate 3, and, to which, on the other, a connecting rod 7 is pivotally connected in the joint or pivot point 6. A crank or pivot arm 9 is pivotally connected to the connecting rod 7 in the joint or pivot point 8, whose other joint or pivot point is designated by reference numeral 16.

The second four-jointed transmission includes a crank or pivot arm 4 which can also be pivoted about the common joint or pivot point 1 and is connected at a fixed angle with the crank or pivot arm 5. A rod 13 of the second four-jointed transmission is pivotally connected in the joint or pivot point 14 of the crank or pivot arm 4 which establishes a pivotal connection to the crank or pivot arm 11 which is pivotally connected with the base plate 3 in the joint or pivot point 2.

A couple 15 connects the joint or pivot point 16 of the first four-jointed transmission with the joint or pivot point 14 of the other four-jointed transmission. The rod 13 and the couple 15 are fixedly connected with each other at a predetermined angle so that they can be pivoted only in unison about the joint or pivot point 14.

An articulated window lifter utilizing the two four-jointed transmissions is now illustrated in FIG. 2, whose windowpane 117 is lowered within predetermined boundaries and thereby by-passes door-frame parts and the like lying in its path and is thereby laterally displaced and pivoted.

The window-lifter according to FIG. 2 includes a pinion 118 supported on the base plate 103 which engages with a toothed sector 119 which is pivotally supported on the base plate 103 in the common pivot point 101 and to which the various other linkage members are pivotally connected.

The toothed sector 119 represents at the same time two cranks or pivot arms rigidly connected with each other, namely, crank or pivot arm 4 and the crank or pivot arm 5 according to FIG. 1 which are indicated in dash and dot lines in FIG. 2 and are designated by reference numerals 4 and 5 in parenthesis. The one joint or pivot point 106 formed by the toothed sector 119 is connected by a connecting rod 107 with a fastening plate 121 which carries the windowpane 117. This fastening plate 121 includes the joint or pivot point 108 as well as a further joint or pivot point, i.e., the couple joint 116. This couple pivot point 116 is connected by way of the couple 15 with the joint or pivot point 114 of the other four-jointed transmission that includes a rod 13. The couple 15 and the rod 13 are formed in this embodiment by a triangularly shaped lever 122 so that they are always under a fixed angle to one another, under which they can be pivoted in unison about the joint or pivot point 114 located at the toothed sector 119. This other four-jointed transmission includes further a crank or pivot arm 111 which is pivotally connected in the joint or pivot point 112 at the triangularly shaped lever 122, on the one hand, and in the fixed joint or pivot point 2 arranged on the base plate 103, on the other.

A U-shaped slide shoe 123 which is secured at the fastening plate 121 effects a lateral guidance of the fastening plate 121 with respect to a slide rail 124, whereby the legs 126 of the slide shoe 123 extend over the edge 125 of the slide rail 124. The slide shoe 123 therefore ensures a cross support of the fastening plate 121 so that the latter cannot be laterally displaced relative to the rail 124 along the path in the downward direction, i.e., transversely to the longitudinal direction of the vehicle.

FIG. 3 illustrates in schematic view the arrangement of a windowpane in a door of a motor vehicle and the progress of the stroke movement. Starting from the uppermost position 17*a* of the windowpane 17, the pane 17 is brought along its rear edge 23*a* with corner points of the windowpane 17 being displaced along or following the curves or paths 28, 29 and 30 into the lowermost position 17*b*. The area 31 of a door column and the area 32 of a rear column are thereby by-passed. In the lowermost position 17*b* of the windowpane 17, it becomes possible by the pivot movement of the pane 17 in the counterclockwise direction which took place during the stroke movement, that the lower boundary 33 of the pane 17 does not contact the wheel casing 34 and the lower boundary 35 of the door opening.

FIG. 4 illustrates another embodiment of a window lifter according to the present invention in which according to the same principle a windowpane can be lowered nearly straight by a change of the lever lengths and by another arrangement thereof and can thereby be held nearly parallel. The individual crank or pivot arms and the individual joints or pivot points have the same reference numerals as the corresponding crank or pivot arms and pivot points of FIGS. 1 to 3 except that reference numerals of the 200 series are used.

The crank or pivot arm 11 (211*a* and 211*b*) carries out only very small movements. It can therefore be replaced by a slot guidance which extends from the pivot point 212*a* to pivot point 212*b*.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An articulated window lifter for a windowpane which not only may have to be lowered within predetermined limits but also may have to be laterally displaced and pivoted by reason of vehicle parts by lying along its way and to be by-passed, comprising a base plate means, and a pinion supported in said base plate means and engaging with a toothed means pivotally supported on the base plate means, characterized in that two multi-joint transmission linkage means are used in superposed relationship which include a common fixed pivot point on said base plate means, one of said multi-joint transmission linkage means having a further fixed pivot point on said base plate means and including first and second means, one of said first and second means is pivotally supported in said common fixed pivot point and the other of said first and second means is pivotally supported in said further fixed pivot point and third means for operatively connecting said first and second means with each other, the other multi-joint transmission linkage means also including first and second means, the first means of said other linkage transmission means being operatively connected under a fixed angle with one of said first and second means of said one transmission linkage means, fourth means for operatively connecting the first means of said other transmission linkage means with the second means thereof, and fifth means for operatively connecting the second means of said other transmission linkage means with said one of said first and second means and with the third means of the one transmission linkage means, said fifth means being connected with said third means of said one transmission linkage means under a fixed angle, and in that the toothed means is defined at least in part by the first means of said one and other transmission linkage means.

2. An articulated window lifter according to claim 1, characterized in that an apex point of said last-mentioned fixed angle is arranged on the toothed means.

3. An articulated window lifter according to claim 2, wherein said first and second means of said one of said other transmission linkage means form in effect pivot arms.

4. An articulated window lifter according to claim 3, wherein said third means forms in effect a connecting rod operatively connecting the pivot arms formed by the first and second means of said one transmission linkage means.

5. An articulated window lifter according to claim 4, wherein the fourth means of the other transmission linkage means forms in effect a connecting rod operatively connecting the pivot arms formed by the first and second means of the other transmission means.

6. An articulated window lifter according to claim 5, wherein said fifth means is a couple operatively connecting the pivot arm formed by the second means of the other transmission linkage means with the pivot arm formed by the first means of said one transmission linkage means and with the connecting rod formed by the third means of the one transmission linkage means.

7. An articulated window lifter according to claim 6, characterized in that the couple formed by said fifth means is under a fixed angle to the connecting rod formed by the third means of said one transmission linkage means.

8. An articulated window lifter according to claim 7, characterized in that the toothed means is a toothed sector pivotally supported on the base plate means in said common fixed pivot point and forming in effect the first means of both transmission linkage means.

9. An articulated window lifter according to claim 8, characterized in that the second means of the other transmission linkage means is formed by a windowpane support member.

10. An articulated window lifter according to claim 9, characterized in that the third means of said one transmission linkage means and the fifth means of said other transmission linkage means are formed by a unitary member.

11. An articulated window lifter according to claim 10, characterized in that the unitary member is substantially triangularly shaped.

12. An articulated window lifter according to claim 11, characterized in that the pinion adapted to be rotated by a window operator meshes with the teeth provided along the outer circumference of the toothed sector to pivot the latter about the common fixed pivot point and thereby actuates the two transmission linkage means.

13. An articulated window lifter according to claim 12, characterized in that the two transmission linkage means are each a four-jointed linkage system.

14. An articulated window lifter according to claim 2, characterized in that the toothed means is a toothed sector pivotally supported on the base plate means in said common fixed pivot point.

15. An articulated window lifter according to claim 14, characterized in that the toothed sector represents at the same time two pivot arms formed by the first means of the two multi-jointed transmission linkage means rigidly connected with each other, one pivot point formed by the toothed sector being pivotally connected by way of a connecting rod formed by the fourth means of said other transmission linkage means with a fastening plate means formed by the second means of the other transmission linkage means and retaining the windowpane, said fastening plate means including a first pivot pin as well as a second pivot point of the other transmission linkage means, said second pivot point being operatively connected by way of a couple means with a pivot point of the one transmission linkage means which is disposed at the toothed sector, a rod formed by the third means of said one transmission linkage means and connected under a fixed angle with the couple means being pivotally connected within said last-mentioned pivot point, the second means of said one transmission linkage means including a pivot arm being pivotally connected with said last-mentioned rod in a further pivot point, and said last-mentioned pivot arm being pivotally connected on the base plate means in the further fixed pivot point.

16. An articulated window lifter according to claim 15, characterized in that a slide shoe means is secured at the fastening plate means which effects a lateral guidance of the fastening plate means with respect to a slide rail.

17. An articulated window lifter according to claim 16, characterized in that said slide shoe means includes legs extending over the edge of the slide rail.

18. An articulated window lifter according to claim 17, characterized in that by a change of the arrangement and of the length of the articulated parts of the multi-jointed transmission linkage means, the movement path of the windowpane can be changed and can be matched and adapted to other conditions whereby it becomes possible to lower frameless windows or windows with non-parallel edges without necessary guide elements or to lower windows even nearly straight or nearly without pivoting thereof.

19. An articulated window lifter according to claim 18, characterized in that at least one pivot arm carries out only small movements and is constituted by a slotted guide means.

20. An articulated window lifter according to claim 1, characterized in that the second means of the other transmission linkage means includes a windowpane support member.

21. An articulated window lifter according to claim 20, characterized in that the third means of said one transmission linkage means and the fifth means of said other transmission linkage means are formed by a unitary member.

22. An articulated window lifter according to claim 1, characterized in that the two transmission linkage means are each a four-jointed linkage system.

23. An articulated window lifter according to claim 14, characterized in that the pinion adapted to be rotated by a window operator meshes with the teeth provided along the outer circumference of the toothed sector to pivot the latter about the common fixed pivot point and thereby actuates the two transmission linkage means.

24. An articulated window lifter according to claim 1, characterized in that by a change of the arrangement and of the length of the articulated parts of the multi-jointed transmission linkage means, the movement path of the windowpane can be changed and can be matched and adapted to other conditions whereby it becomes possible to lower frameless windows or windows with non-parallel edges without necessary guide elements or to lower windows even nearly straight or nearly without pivoting thereof.

25. An articulated window lifter according to claim 24, characterized in that at least one of said first and second means carries out only small movements and is constituted by a slotted guide means.

* * * * *